US010693259B2

(12) United States Patent
Ho et al.

(10) Patent No.: US 10,693,259 B2
(45) Date of Patent: Jun. 23, 2020

(54) CONNECTOR PORT ASSEMBLY FOR AN ELECTRONIC DEVICE

(71) Applicant: HEWLETT-PACKARD DEVELOPMENT COMPANY, L.P., Houston, TX (US)

(72) Inventors: Hsin-Tsung Ho, Taipei (TW); Chia-Ming Tsai, Taipei (TW); Keng-Ming Chang, Taipei (TW)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/092,961

(22) PCT Filed: Jul. 29, 2016

(86) PCT No.: PCT/US2016/044635

§ 371 (c)(1),
(2) Date: Oct. 11, 2018

(87) PCT Pub. No.: WO2018/022076

PCT Pub. Date: Feb. 1, 2018

(65) Prior Publication Data

US 2019/0190205 A1 Jun. 20, 2019

(51) Int. Cl.

| | |
|---|---|
| ***H01R 13/631*** | (2006.01) |
| ***H01R 13/6598*** | (2011.01) |
| ***H01R 13/74*** | (2006.01) |

(52) U.S. Cl.

CPC ..... *H01R 13/6315* (2013.01); *H01R 13/6598* (2013.01); *H01R 13/74* (2013.01); *H01R 13/748* (2013.01)

(58) Field of Classification Search

CPC ..... H01R 13/6315; H01R 12/91
USPC ..... 439/2, 382, 383, 384, 385, 248, 246
See application file for complete search history.

(56) References Cited

U.S. PATENT DOCUMENTS

| | | | |
|---|---|---|---|
| 4,647,130 | A | 3/1987 | Blair et al. |
| 5,443,325 | A | 8/1995 | Simonelli et al. |
| 5,443,328 | A | 8/1995 | Alcock |
| 6,123,568 | A | 9/2000 | Bullough et al. |
| 6,139,354 | A | 10/2000 | Broussard |
| 7,288,000 | B2 | 10/2007 | Liu et al. |

(Continued)

FOREIGN PATENT DOCUMENTS

| | | | |
|---|---|---|---|
| CN | 103606776 | B | 1/2016 |
| RU | 2408116 | C1 | 12/2010 |

(Continued)

OTHER PUBLICATIONS

Apple MacBook Pro Air Charger Cable Saver Protector for Charging Wire Protection, <http://www.ebay.com/itm/Apple-MacBook-Pro-Air-Charger-Cable-Saver-Protector-for-Char>.

*Primary Examiner* — Ross N Gushi
(74) *Attorney, Agent, or Firm* — HPI Patent Department

(57) ABSTRACT

In an example, a connector port assembly for use in an electronic device is disclosed. The connector port assembly may include a connector port, a fastener assembly and a flexible ring. The fastener assembly may fasten the connector port to a casing of the electronic device through at least one resilient member. The flexible ring may be disposed around an outer surface of the connector port. The fastener assembly and flexible ring may provide bend angle for the connector port.

15 Claims, 3 Drawing Sheets

(56) References Cited

U.S. PATENT DOCUMENTS

| | | | | |
|---|---|---|---|---|
| 8,408,927 | B2 * | 4/2013 | Tashiro ..... | H01R 4/70<br>439/247 |
| 8,632,260 | B2 | 1/2014 | Szilagvi | |
| 2008/0214045 | A1 | 9/2008 | Tu et al. | |
| 2009/0181572 | A1 | 7/2009 | Tracy et al. | |
| 2015/0222048 | A1 | 8/2015 | Goulbourne | |

FOREIGN PATENT DOCUMENTS

| | | | |
|---|---|---|---|
| RU | 124431 | U1 | 1/2013 |
| RU | 128792 | U1 | 5/2013 |
| TW | 201310798 | A | 3/2013 |
| TW | 201516623 | A | 5/2015 |
| WO | WO-2003005495 | A1 | 1/2003 |

* cited by examiner

CONNECTOR PORT ASSEMBLY FOR AN ELECTRONIC DEVICE

BACKGROUND

Electronic devices may include various types of connector ports to facilitate connection to external peripheral devices. Example connector ports may include power ports, universal serial bus (USB) ports, video input and output ports, Ethernet ports, microphone connector ports, and the like. For instance, a laptop computer may have a power port (e.g., direct current (DC) power jack) to receive a plug-in arrangement of a power cable for powering the laptop computer.

BRIEF DESCRIPTION OF THE DRAWINGS

Examples are described in the following detailed description and in reference to the drawings, in which.

DETAILED DESCRIPTION

An electronic device may have various types of connector ports to facilitate the connection of peripheral devices. The connector ports may be integrated onto a circuit board of the electronic device, for instance, via soldering. For example, the connector ports may be integrated onto a motherboard of a notebook computer or onto an expansion card of a desktop computer. Further, each connector port may be used to connect a peripheral device to the motherboard and may receive a plugin arrangement of an external connector cable of the peripheral device. Sometimes, the connector port may be susceptible to an accidental break or detached from the motherboard due to a significant bending-angle of the plug associated with the external connector cable, for instance, when an excess force is applied on the plug. In this case, the excess force may gradually loosen the connector port, thereby making the connector port unreliable and inoperable.

Examples described herein may provide a connector port assembly for use in an electronic device. The connector port assembly may include a connector port, a fastener assembly, and a flexible ring. The fastener assembly may fasten the connector port to a casing of the electronic device through at least one resilient member. The flexible ring may be disposed around an outer surface of the connector port. In one example, the flexible ring is disposed such that the flexible ring may fill a gap formed between the connector port and the casing at an opening slot defined in the casing to receive a plug of an external connector cable. Example flexible ring and resilient member may be made of a material selected from a group consisting of thermoplastic polyurethane, nanotube sponges, silicone rubber and conductive plastic filled elastomers. Thereby, the fastener assembly and the flexible ring may provide needed bend angle for the connector port relative to axial and radial movement of the plug associated with the external connector cable.

Examples described herein may provide flexibility to the connector port relative to a movement of the external connector cable that is plugged-in to the connector port, thereby may averting damage/deformation caused to the connector port due to excess force applied by the cable-side connector. Further, examples described herein may improve the structural strength and enhance reliability/durability of the connector port.

Figure 1:
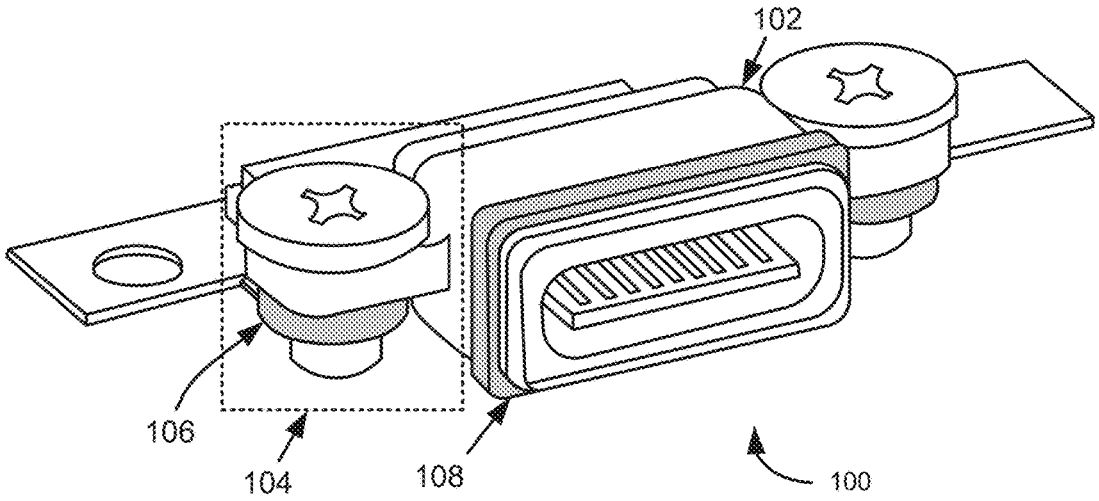
FIG. 1 depicts a front view of an example connector port assembly.

FIG. 1 depicts a front view of an example connector port assembly 100 for use in an electronic device. Example electronic device may be notebook computer, laptop computer, tablet computer, smartphone, desktop computer, and the like. Connector port assembly 100 may include a connector port 102 that may provide connection interface (e.g., communication interface, power interface and the like) for the electronic device. For example, connector port 102 may facilitate the connection of external peripheral devices. Example connector port 102 may include a power port, a universal serial bus (USB) port, a video input and output port, an Ethernet port, a microphone connection port, a speaker/amplifier input port, and a high-definition multimedia interface (HDMI) port, and the like. Example peripheral device may be power adapter, external data storage device (e.g., a flash drive or an external hard drive), printer, or any other device that can be connected to the electronic device via connector port 102.

For example, a laptop computer may have a power port (e.g., DC power jack) to receive a plug-in arrangement of a power cable for powering the laptop computer. In another example, the laptop computer may have an input/output (I/O) port (e.g., I/O jack) to receive a plug-in arrangement of a USB storage device (e.g., pen drive) for accessing the content stored in the USB storage device. The terms "plug", "connector plug", and "plug-in arrangement" can be used interchangeably throughout the document.

As shown in FIG. 1, connector port assembly 100 may include the connector port 102, a fastener assembly 104, and a flexible ring 108. Fastener assembly 104 may fasten connector port 102 to a casing of the electronic device through at least one resilient member 106. In one example, connector port 102 may be fastened to the casing by securing fastener assembly 104 to a screw boss provided at a base of the casing. Example fastener assembly 104 may be explained in detail in FIG. 2.

Figure 2:
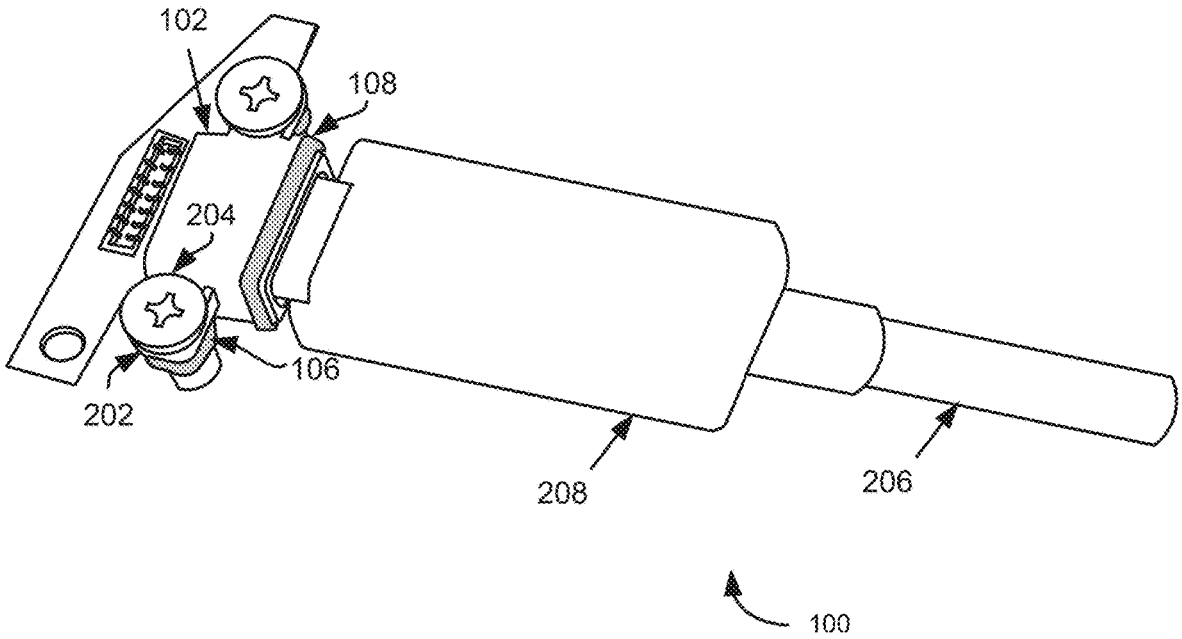
FIG. 2 depicts a top view of the example connector port assembly shown in FIG. 1, connected to an external connector cable.

FIG. 2 depicts a top view of the example connector port assembly 100 as shown in FIG. 1. As shown in 200 of FIG. 2, the fastener assembly may include a first and second portions 202 laterally extending from connector port 102 on opposite sides of connector port 102. Each of first and second portions 202 may include an unthreaded through-hole. The fastener assembly may include resilient member 106 disposed between each of first and second portions 202 and a respective screw boss portion in the casing having a threaded hole. The resilient member 106 may include an opening that is co-axial with the threaded hole and the unthreaded through-hole. Furthermore, fastener assembly may include fastener 204 to fasten connector port 102 to the casing. In one example, fasteners 204 may be disposed at each of first and second portions 202 through the unthreaded through-hole, the opening of resilient member 106 and threadedly engaging with the threaded hole of the screw boss portion. This is explained in detail in conjunction with FIGS. 3 and 4. The terms "casing" and "housing" can be used interchangeably throughout the document.

Further, flexible ring 106 may be disposed around an outer surface of connector port 102. Upon connecting connector port assembly 100 to the electronic device, flexible ring 106 may fill a gap formed between connector port 102 and the casing at an opening slot defined in the casing to receive an external connector cable 206. This is explained in detail in conjunction with FIG. 4A. In one example, fastener assembly 104 and flexible ring 106 may provide needed bend angle for connector port 102 relative to axial and radial movement of plug 208 associated with external connector cable 206 (e.g., as shown in FIG. 2). In one example, resilient member 106 and flexible ring 108 may act as a cushion/compressible material between connector port 102 and casing of the electronic device. Resilient member 106 and flexible ring 108 may be compressible and electromagnetically conductive. Example flexible ring 108 and resilient member 106 may be made of a material selected from a group consisting of thermoplastic polyurethane, nanotube sponges, silicone rubber, conductive plastic filled elastomers and the like.

Figure 3:
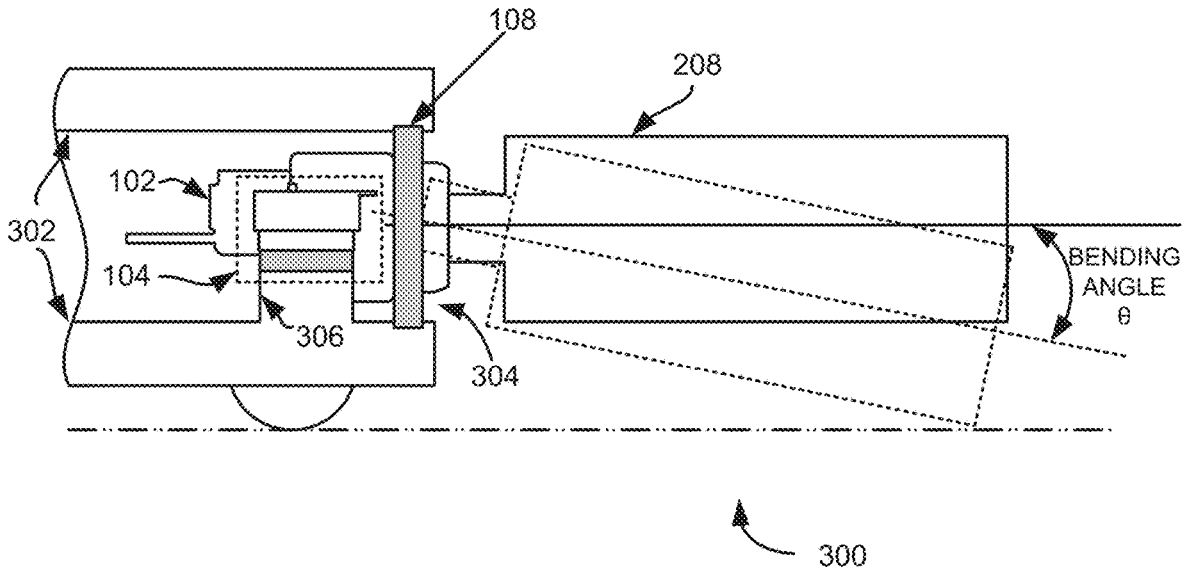
FIG. 3 depicts a cross sectional view of an example electronic device including a housing in which the connector port assembly of FIG. 1 is disposed.

Turning now to FIG. 3, which depicts a cross sectional view of an example electronic device 300 including a housing 302 in which connector port assembly 100 of FIG. 1 is disposed. As shown in FIG. 3, housing 302 may include an opening slot 304 to receive external connector cable 206. Further, an opening edge (e.g., socket/receptacle portion) of connector port 102 may be disposed in opening slot 304. Used herein, the socket/receptacle portion may refer to a portion at which connector port 102 may interface with plug-in arrangement 208 of external connector cable 206. Further, flexible ring 108 may be disposed around an outer surface of connector port 102 such that flexible ring 108 may be formed between casing 302 and connector port 102 within opening slot 304. In this example, flexible ring 108 may be disposed in such a way that flexible ring 108 may fill a gap formed between connector port 102 and housing 302 at opening slot 304.

Further, housing 302 may include at least one screw boss portion 306 for securing fastener assembly 104. In one example, fastener assembly 104 may fasten connector port 102 to housing 302 (e.g., at screw boss portion 306) through resilient member 106.

In one example, when an excess force is applied on plug 208 (e.g., USB or DC plug) of external connector cable 206, at least portion of resilient member 106 of fastener assembly 104 and flexible ring 108 may move in a direction corresponding to a direction of the applied excess force. In this case, resilient member 106 of fastener assembly 104 and flexible ring 108 may be retracted to a position (i.e., different from an original position) corresponding to the axial and radial movement of connector plug 208 on which the excess force is applied. Further, resilient member 106 of fastener assembly 104 and flexible ring 106 may provide flexibility to connector port 102 to bend and/or move (e.g., by a bending angle θ) relative to the movement of connector plug 208. Further, floating ring 108 and resilient member 106 may enable connector port 102 to retain to its original position. Thus, the ability of resilient member 106 and flexible ring 108 to flex may prevent damage/deformation that may be caused to connector port 102 when external connected cable 206 is plugged-in/moved in various directions.

For the purpose of explanation, fastener assembly 104 is shown as fastening connector port 102 to base of housing 302 of electronic device 300, without limitation connector port 102 may be fastened to side walls or any other portion of housing 302, since the entire structure may be placed in any other oriented position.

Figure 4A:
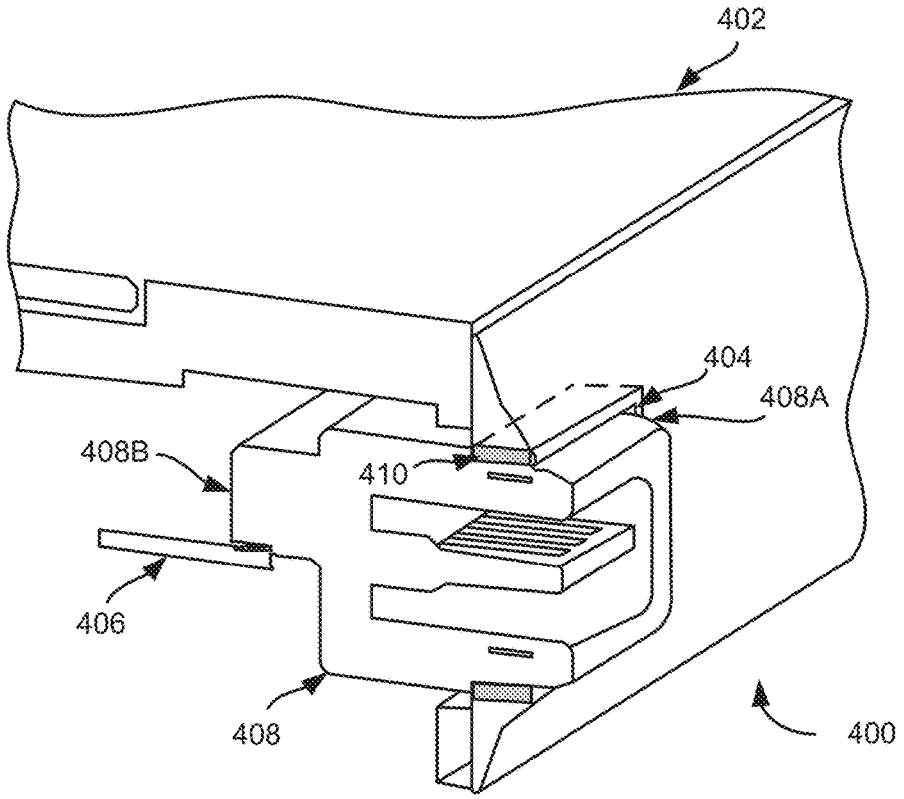
FIG. 4A depicts another cross sectional view of an example electronic device depicting a flexible ring disposed between an outer surface of a connector port and device housing at an opening slot.
Figure 4B:
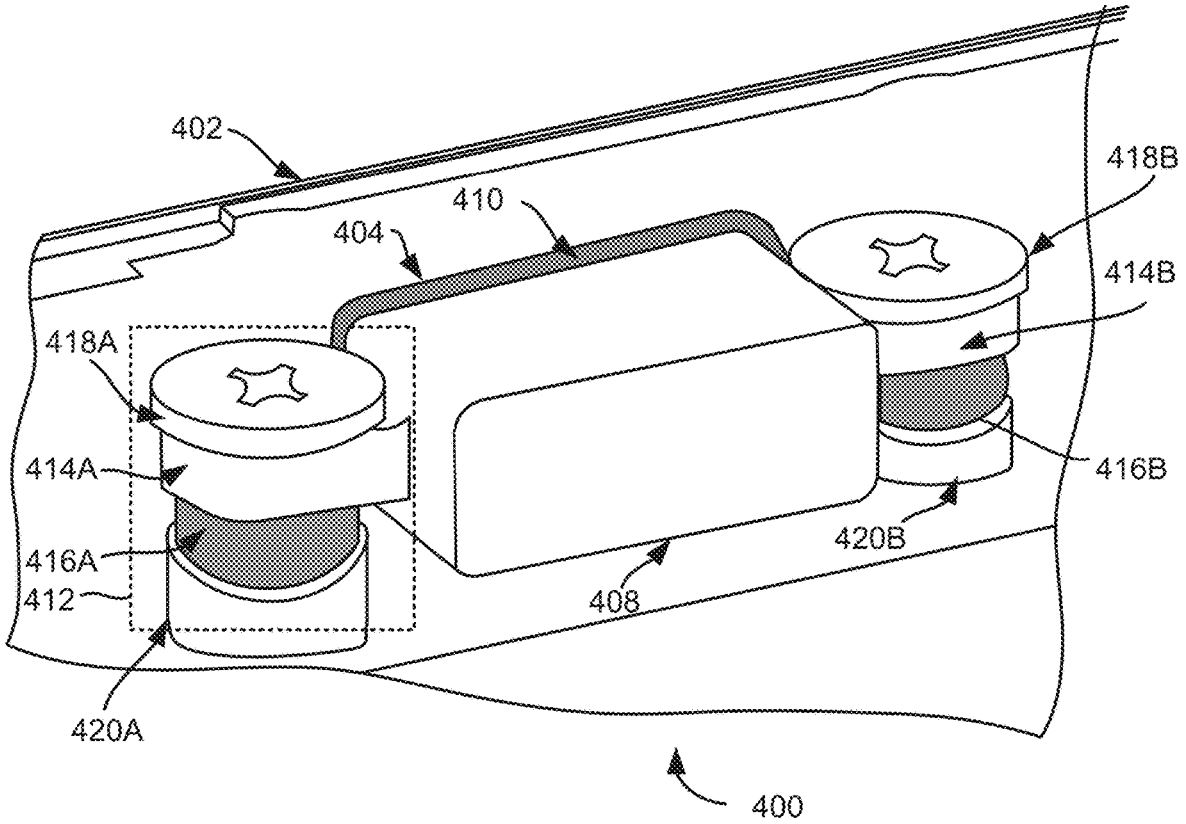
FIG. 4B depicts a rear view of an example connector port assembly disposed in an example electronic device.

FIG. 4A depicts another cross sectional view of an example electronic device 400 depicting a flexible ring 410 disposed between an outer surface of a connector port 408 and device housing 402 at an opening slot 404. FIG. 4B depicts a rear view of an example connector port assembly disposed in example electronic device 400. Particularly, FIG. 4A illustrates electronic device 400 that includes a housing 402 defining at least one opening slot 404 and a circuit board 406 mounted inside housing 402. For example, circuit board 406 may be a motherboard in case of a notebook computer or an expansion card in case of a desktop computer. Connector port 408 may be connected at an edge of circuit board 406, for example, via soldering or a wired connection. Further, connector port 408 may be disposed in opening slot 404 to receive an external connector cable (e.g., as shown in FIG. 2).

In the example shown in FIG. 4A, opening edge (e.g., a socket/receptacle portion) at a front side 408A of connector port 408 may be disposed corresponding to opening slot 404. Further, electrical-contacts at a rear side 408B of connector port 408 may be soldered to circuit board 406. In the example shown in FIG. 4A, a flexible ring 410 may be disposed between an outer surface of connector port 408 and housing 402 at opening slot 404. Flexible ring 410 may be sized to fill a gap formed between connector port 408 and housing 402 at opening slot 404. Furthermore, as shown in FIG. 4B, fastener assembly 412 may fasten connector port 408 to housing 402 such that connector port 408 is suspended as a floating structure in housing 402. Resilient members 416 of fastener assembly 412 and flexible ring 410 may act as a cushion/compressible material that is selected from a group consisting of thermoplastic polyurethane, nanotube sponges, silicone rubber and conductive plastic filled elastomers.

In one example as shown in FIG. 4B, fastener assembly 412 may include side portions 414A and 414B, resilient members 416A and 416B, and fasteners 418A and 418B (e.g., mounting screw). The side portions (e.g., side portion 414A and side portion 414B) may laterally extending from connector port 408 and may have an unthreaded through-hole. Resilient members 416A and 416B may be disposed between side portions 414A and 414B and screw boss portions 420A and 420B, respectively. Each of screw boss portions 420A and 420B may include a threaded hole. In one example, each of resilient members 416A and 416B may include an opening that is co-axial with the threaded hole and the unthreaded through-hole. Fasteners/mounting screws 418A and 418B may fasten connector port 408 to housing 402 by disposing mounting screws 414A and 414B through the respective unthreaded through-hole, the opening of the resilient member and threadedly engaging with the threaded hole.

In this case, flexible ring 410 and fastener assembly 412 with resilient member 416 may provide structural strength in addition to a strength provided by the soldering of connector port 408 onto circuit board 406. In one example, flexible ring 410 and flexible fastener assembly 412 may protect connector port 408 during axial and radial movement of an external connector cable that is connected to connector port 408. For example, when an excess force applied on the external connector cable, resilient member 416 and flexible ring 410 may get compressed/decompressed and may compensate the excess force, thereby preventing connector port 408 from deformation. Also, loosening or detachment of connector port 408 from circuit board 406 may be prevented during abnormal bending/movement of connector plug of the external connector cable.

Although the examples of FIGS. 1-4 depicts that the flexible ring as being disposed around an outer surface of connector port 408, no limitation as to the positioning of the entire structure is to be inferred, since the entire structure may be placed in any other oriented position. Further, the size and shape of fastener assembly 104 and flexible ring 106 may be varied depending on the configuration and dimension of the particular connector being used. For example, flexible ring 106 can be of any shape, for example, rectangular, circular, square and the like.

It may be noted that the above-described examples of the present solution are for the purpose of illustration only. Although the solution has been described in conjunction with a specific embodiment thereof, numerous modifications may be possible without materially departing from the teachings and advantages of the subject matter described herein. Other substitutions, modifications and changes may be made without departing from the spirit of the present solution. All of the features disclosed in this specification (including any accompanying claims, abstract and drawings), and/or all of the steps of any method or process so disclosed, may be combined in any combination, except combinations where at least some of such features and/or steps are mutually exclusive.

The terms "include," "have," and variations thereof, as used herein, have the same meaning as the term "comprise" or appropriate variation thereof. Furthermore, the term "based on", as used herein, means "based at least in part on." Thus, a feature that is described as based on some stimulus can be based on the stimulus or a combination of stimuli including the stimulus.

The present description has been shown and described with reference to the foregoing examples. It is understood, however, that other forms, details, and examples can be made without departing from the spirit and scope of the present subject matter that is defined in the following claims.

What is claimed is:

1. A connector port assembly for use in an electronic device, comprising:

a connector port;

a fastener assembly to fasten the connector port to a casing of the electronic device through at least one resilient member; and a flexible ring disposed around an outer surface of the connector port, wherein the fastener assembly and the flexible ring are to provide a bend angle for the connector port;

wherein the fastener assembly includes a first resilient member securable between the fastener assembly and a screw boss portion of the casing, the first resilient member including an opening to receive a fastener to fasten the connector port to the casing.

2. The connector port assembly of claim 1, wherein the flexible ring is to fill a gap formed between the connector port and the casing at an opening slot defined in the casing to receive an external connector cable.

3. The connector port assembly of claim 1, wherein the fastener assembly further comprises:

first and second portions laterally extending from the connector port on opposite sides, wherein each of the first and second portions having an unthreaded through-hole;

a second resilient member, wherein each of the first resilient member and the second resilient member is disposed between one of the first and second portions and a respective screw boss portion in the casing having a threaded hole, and wherein each of the first resilient member and the second resilient member includes a respective opening that is co-axial with the threaded hole and the unthreaded through-hole; and fasteners to fasten the connector port to the casing by disposing a fastener at each of the first and second portions through the unthreaded through-hole, the respective opening of a respective one of the first resilient member and the second resilient member, and threadedly engaging with the threaded hole.

4. The connector port assembly of claim 1, wherein the connector port is selected from a group consisting of a power port, a universal serial bus (USB) port, a video input and output port, an Ethernet port, a microphone connection port, a speaker/amplifier input port, and a high-definition multimedia interface (HDMI) port.

5. The connector assembly of claim 1, wherein the flexible ring and the first resilient member are made of material that is selected from a group consisting of thermoplastic polyurethane, nanotube sponges, silicone rubber and conductive plastic filled elastomers.

6. A portable computer comprising:

a housing defining an opening slot;

a connector port having an opening edge disposed in the opening slot to receive an external connector cable;

a fastener assembly to fasten the connector port to the housing through a resilient member; and a flexible ring disposed around an outer surface of the connector port in the opening slot, wherein the flexible ring to fill a gap formed between the connector port and the housing at the opening slot, wherein the resilient member and the flexible ring are to provide a bend angle for the connector port.

7. The portable computer of claim 6, wherein the housing comprising at least one screw boss portion having a threaded hole, and wherein the fastener assembly comprising:

at least one side portion laterally extending from the connector port and having an unthreaded through-hole;

at least one resilient member disposed between the at least one side portion and the at least one screw boss portion, wherein the at least one resilient member comprising an opening that is co-axial with the threaded hole and the unthreaded through-hole; and at least one mounting screw to fasten the connector port to the housing by disposing the at least one mounting screw through the unthreaded through-hole, the opening of the at least one resilient member and threadedly engaging with the threaded hole.

8. The portable computer of claim 6, wherein the connector port is selected from a group consisting of a power port, a universal serial bus (USB) port, a video input and output port, an Ethernet port, a microphone connection port, a speaker/amplifier input port, and a high-definition multimedia interface (HDMI) port.

9. The portable computer of claim 6, wherein the flexible ring and the resilient member are made of material that is selected from a group consisting of thermoplastic polyurethane, nanotube sponges, silicone rubber and conductive plastic filled elastomers.

10. The portable computer of claim 6, wherein the fastener assembly is to fasten the connector port to the housing such that the connector port is suspended as a floating structure in the housing.

11. The portable computer of claim 6, wherein the portable computer is selected from a group consisting of notebook computer, laptop computer, and tablet computer.

12. An electronic device comprising:

a housing defining at least one opening slot;

a circuit board mounted inside the housing;

a connector port disposed at an edge of the circuit board and in the at least one opening slot to receive an external connector cable;

a flexible fastener assembly to fasten the connector port to the housing such that the connector port is suspended as a floating structure in the housing; and a flexible ring disposed between an outer surface of the connector port and the housing at the opening slot.

13. The electronic device of claim 12, wherein the housing comprising at least one screw boss portion having a threaded hole, and wherein the flexible fastener assembly comprising:

at least one side portion laterally extending from the connector port and having an unthreaded through hole;

at least one resilient member disposed between the at least one side portion and the at least one screw boss portion, wherein the at least one resilient member comprising an opening that is co-axial with the threaded hole and the unthreaded through-hole; and at least one mounting screw to fasten the connector port to the housing by disposing the at least one mounting screw through the unthreaded through-hole, the opening of the at least one resilient member and threadedly engaging with the threaded hole.

14. The electronic device of claim 12, wherein the connector port is selected from a group consisting of a power port, a universal serial bus (USB) port, a video input and output port, an Ethernet port, a microphone connection port, a speaker/amplifier input port, and a high-definition multimedia interface (HDMI) port.

15. The electronic device of claim 12, wherein the flexible ring and the resilient member are made of material that is selected from a group consisting of thermoplastic polyurethane, nanotube sponges, silicone rubber and conductive plastic filled elastomers, and wherein the flexible ring and the flexible fastener assembly is to protect the connector port during axial and radial movement of the external connector cable that is connected to the connector port.

* * * * *